United States Patent [19]

Caves

[11] 4,127,087

[45] Nov. 28, 1978

[54] ELECTRONIC DRIVE SIGNAL DISTRIBUTION ARRANGEMENT FOR A FUEL INJECTION SYSTEM

[75] Inventor: Francis J. Caves, Brentwood, England

[73] Assignee: Plessey Handel und Investments AG, Zug, Switzerland

[21] Appl. No.: 723,669

[22] Filed: Sep. 15, 1976

[30] Foreign Application Priority Data

Sep. 19, 1975 [GB] United Kingdom ..... 38471/75

[51] Int. Cl.[2] ..... F02M 63/00

[52] U.S. Cl. ..... 123/32 AE; 123/32 EF; 123/119 EE

[58] Field of Search ..... 123/32 EA, 32 EF, 119 EE, 123/148 BA, 32 AE, 119 E; 239/102; 331/116 R

[56] References Cited

U.S. PATENT DOCUMENTS

| | | | |
|---|---|---|---|
| 2,918,911 | 12/1959 | Guiot | 123/32 EA |
| 2,948,273 | 8/1960 | Suttle | 123/32 EA |
| 2,949,900 | 8/1960 | Bodine | 239/102 |
| 3,500,799 | 3/1970 | Benson | 123/32 EA |
| 3,613,649 | 10/1971 | Moss et al. | 123/32 EA |
| 3,677,236 | 7/1972 | Moss | 123/32 AE |
| 3,822,678 | 7/1974 | Bassot et al. | 123/32 EA |
| 3,851,635 | 12/1974 | Murtin et al. | 123/32 EA |
| 3,884,417 | 5/1975 | Sheffield et al. | 239/102 |
| 3,889,162 | 6/1975 | Myers | 123/32 EF |
| 3,890,938 | 6/1975 | Oishi et al. | 123/32 EA |
| 3,903,850 | 9/1975 | Hisada et al. | 123/32 EA |

FOREIGN PATENT DOCUMENTS

| | | | |
|---|---|---|---|
| 1,277,698 | 6/1972 | United Kingdom | 123/32 EA |

OTHER PUBLICATIONS

Hoenig, Payne, "How to Build and Use Electronic Devices without Frustration, Panic, Mountains of Money, or an Engineering Degree", Dec. 1973, pp. 295–298.

*Primary Examiner*—Charles J. Myhre
*Assistant Examiner*—Andrew M. Dolinar
*Attorney, Agent, or Firm*—Fleit & Jacobson

[57] ABSTRACT

An ultrasonic fuel injection system for internal combustion engines comprising a plurality of fuel injection nozzles, a piezoelectric transducer operatively associated with each nozzle, an oscillator for producing an ultrasonic signal for driving the transducers, and gating means responsive to control pulses produced in dependence upon engine operating conditions for feeding the transducers with signal bursts from the oscillator.

4 Claims, 3 Drawing Figures

ELECTRONIC DRIVE SIGNAL DISTRIBUTION ARRANGEMENT FOR A FUEL INJECTION SYSTEM

Figure 1:
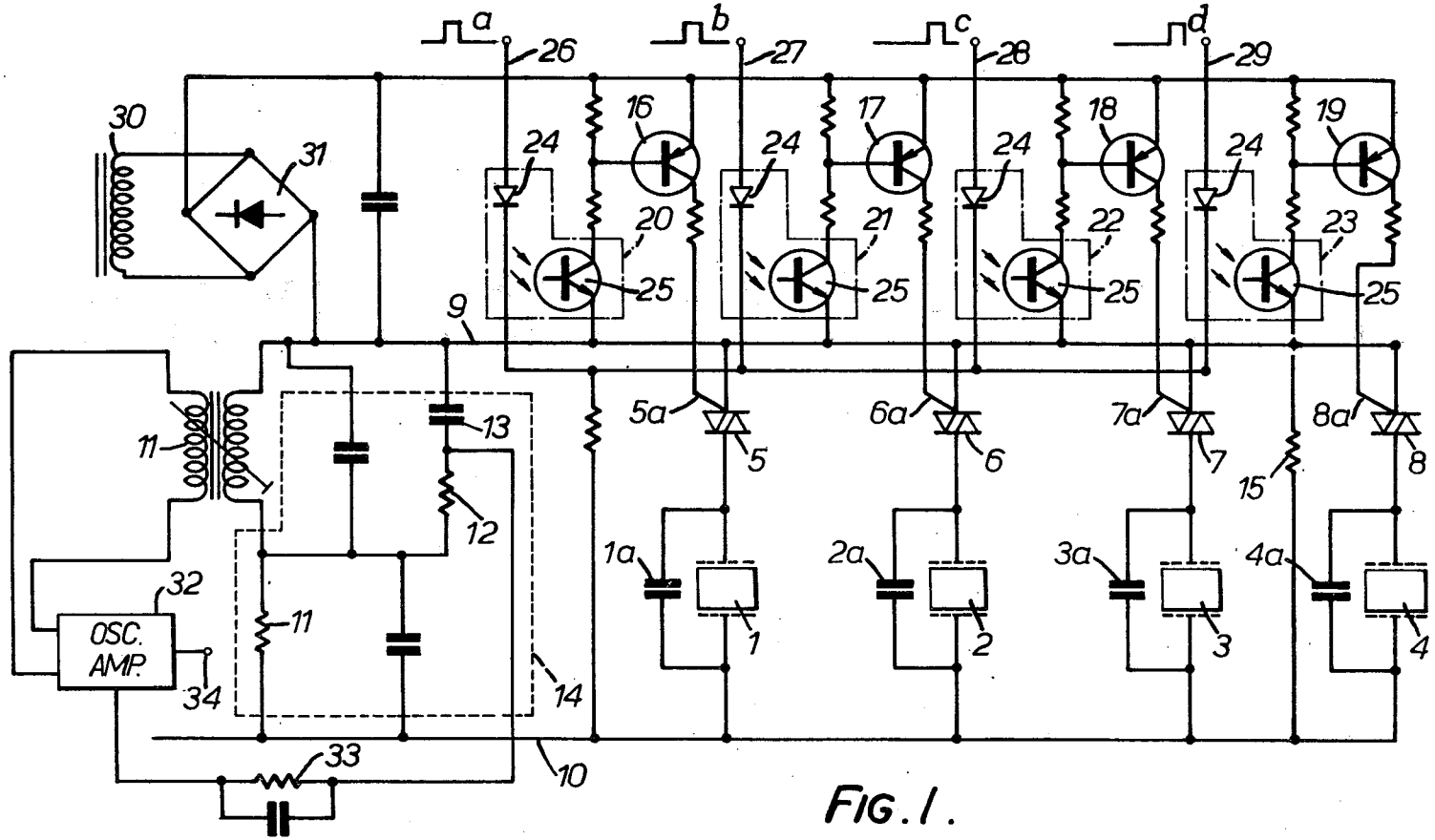

This invention relates to fuel injection systems for internal combustion engines and more especially it relates to such systems for use in conjunction with internal combustion engines having ultrasonic fuel injection facilities.

According to the present invention an ultrasonic fuel injection system for an internal combustion engine comprises a plurality of fuel injection nozzles, a piezoelectric transducer operatively associated with each nozzle, an oscillator for producing an ultrasonic signal for driving the transducers, and gating means responsive to control pulses produced in dependence upon engine operating conditions for feeding the transducers with signal bursts from the oscillator.

The internal combustion engine may have more than one combustion chamber there being provided at least one fuel injection nozzle for each chamber, the transducers operatively associated therewith being fed sequentially. Alternatively the internal combustion engine may have only one combustion chamber provided with two or more nozzles fed from the gating means sequentially or contemporaneously. In this latter arrangement one nozzle may be utilised for starting purposes and may be supplemented by one or more additional nozzles under load conditions.

The nozzles are preferably of the kind which incorporate a ball normally biassed against a valve seat in sealing engagement by fuel pressure and released to admit fuel to a combustion chamber consequent upon the application of an ultrasonic electric drive signal to the transducer with which the nozzle concerned is operatively associated.

Thus in a system having more than one combustion chamber each nozzle is fed in turn with a burst of pulses from the oscillator, the engine speed being determined in dependence upon the length of the bursts.

The control pulses, one of which initiates each signal burst fed from the oscillator to one of the transducers, may be produced by a magnetically operated device such as a reed relay, a reed operating magnet or magnets being fixed to a suitable moving part of the engine to produce control pulses which can be used to indicate the commencement of each induction stroke. For example one or more magnets may be connected to rotate with the cam shaft of an OHC engine so as sequentially to operate reed relays and produce the required pulses. Another technique for deriving such pulses may comprise a toothed wheel arranged to rotate with the engine and to originate pulses as each tooth passes a sensor such as an induction coil or opto coupler or the like. The wheel may produce pulses at a frequency which is a multiple of the required frequency pulses produced being fed to a divider to produce the correct rate, one tooth may be longer than the other in order to indicate top dead centre. In an alternative arrangement a Hall effect device may be used triggered by a rotating magnet operatively associated with the engine.

The length of each signal burst from the oscillator is controlled in dependence upon engine operating conditions and one method of control is to adjust the pulse length in dependence upon engine revolutions on the one hand and throttle butterfly angle on the other hand. Signals may be produced from a simple rotary potentiometer to indicate butterfly angle and from a tacho generator to indicate engine revolutious the two parameters being computed to control the length of the oscillator signal bursts.

An alternative method of controlling the length of the oscillator signal bursts is to control the burst in dependence upon engine manifold pressure as compared with atmospheric pressure.

The gating means may comprise a plurality of triacs one associated with each transducer, the traics being connected so that pulses from the oscillator are fed to the transducers via the triacs which are conduction controlled in dependence upon the control pulses.

The control electrodes or gates of the triacs may be fed with the control pulses each via an opto coupler which affords good isolation.

In one arrangement the opto couplers each comprise an input photodiode optically coupled to an output photo transistor and are arranged to feed the triacs with which they are operatively associated each via a coupling transistor.

A power supply for the opto coupler and for the coupling transistor may comprise a winding coupled to the oscillator and arranged to feed the opto coupler and the coupling transistor via a rectifier which may consist of a diode bridge circuit connected to operate as a full-wave rectifier, a dummy load being provided to load the oscillator so as to start the oscillator and to maintain oscillatory output even in the event that one of the triacs does not conduct to load the oscillator with its associated transducer.

Various types of photo coupler may be used and one contemplated alternative type of photo coupler includes a coupling transistor connected in a Darlington configuration to the photo transistor.

Figure 2:
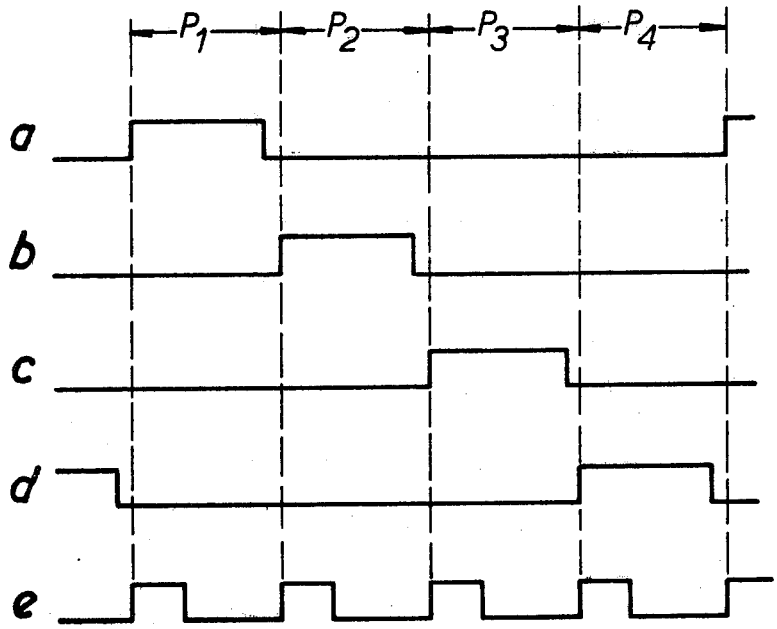
Figure 3:
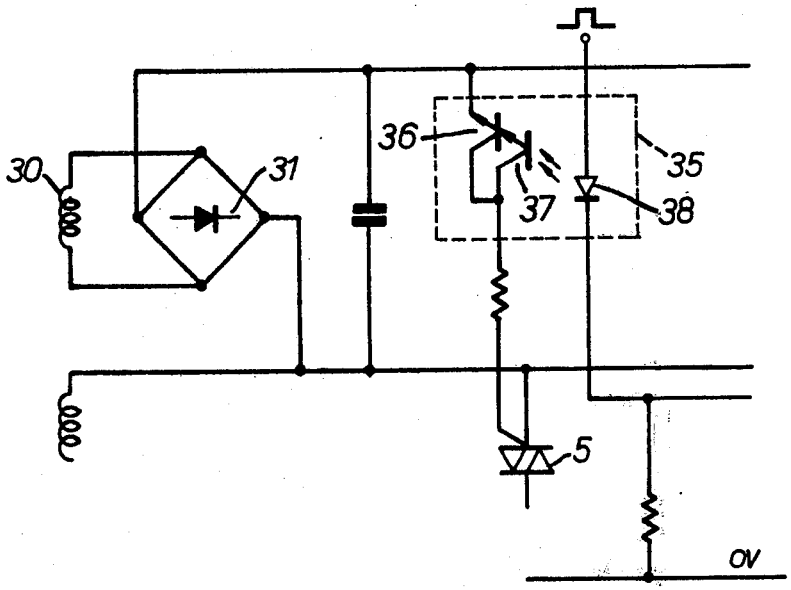

Exemplary embodiments of the invention will now be described with reference to the accompanying drawings in which:

FIG. 1 is a circuit diagram of a system for feeding a plurality of ultrasonically driven fuel injection nozzles from a single oscillator, FIG. 2 is a waveform diagram appertaining to the operation of the circuit shown in FIG. 1, and FIG. 3 is a circuit of an alternative opto coupler configuration for use in the circuit shown in FIG. 1.

Turning now to FIG. 1, four transducers 1, 2, 3 and 4 are shown fed via triaces 5, 6, 7 and 8 respectively. The triaces 5 through 8 are fed via busbars 9 and 10 from an output transformer 11 of an ultrasonic drive oscillator. Resistors 11 and 12 and capacitor 13, shown within the broken line 14 which encloses components forming part of the oscillator, define three arms of a bridge circuit, the other arm of which is formed by a load presented to the busbars 9 and 10 by one or other of the transducers 1 through 4 depending upon which of the triacs 5 to 8 is conductive. In the event that none of the triacs is conductive, a dummy load is provided by resistor 15 which is permanently connected across the busbars 9 and 10. The control electrodes *5a*, *6a*, *7a* and *8a* of the triacs 5 through 8 are fed through coupling transistors 16, 17, 18 and 19 respectively, the coupling transistors 16 through 19 being fed via opto couplers 20, 21, 22 and 23 respectively. Each opto coupler comprises a photo diode 24 and a photo sensitive transistor 25. The opto couplers 20 through 23 are fed via input lines 26, 27, 28 and 29 respectively.

With the arrangement just before described a control pulse on line 26 will operate the photo coupler 20, the coupling transistor 16 and the triac 5 which conducts to couple the transducer 1 to the busbars 9, 10 on which the oscillator signal is applied. Thus it will be appreciated that one or other of the transducers 1 through 4 is driven in dependence upon which of the lines 26 through 29 a control pulse is applied to. Power for the opto couplers and the coupling transistors is derived via a winding 30 inductively coupled to the oscillator and feeding the opto couplers 20 to 23 and coupling transistors 16 to 19 via a diode fullwave bridge rectifier shown schematically at 31. Since the oscillator is always loaded via the busbars 9, 10 with the dummy load 15 the oscillator will always start even if none of the transducers are connected via a triac to the busbars and so power may be fed via the winding 30 to the fullwave rectifier 31 when the oscillator is required to start. The oscillator comprises amplifying components shown within the block 32 and feedback components 33.

The operatin of the circuit will now be described with reference to the waveform diagrams shown in FIG. 2. Referring now to FIG. 2, the induction stroke periods are shown as periods P1, P2, P3 and P4, one period appertaining to each cylinder. A control pulse generation arrangement is provided which operates synchronously with the engine to produce the control pulse trains A, B, C and D which are applied to the lines 26, 27, 28 and 29 respectively. The pulse trains may be produced by any convenient method such as, for example, by means of reed relays which are operated sequentially by a magnet coupled to some rotary part of the engine such as the cam shaft. The oscillator is synchronously controlled by means of pulses applied to line 34 to produce bursts of oscillation as shown in waveform E. Fuel is admitted to the combustion chamber only during the periods of the pulses E and thus it is necessary that the length of the pulse E be controlled in accordance with the operating requirements of the engine. Various methods of adjusting the pulse length have hereinbefore been mentioned. But any convenient method of adjustment may be utilised.

Various modifications may be made to the arrangements shown without departing from the scope of the invention and as shown in FIG. 3, wherein parts corresponding to those shown in FIG. 1 bear the same numerical designations, an alternative photo coupler configuration may be provided as shown within the broken line 35 wherein a coupling transistor 36 is connected in a Darlington configuration with a photo sensitive transistor 37 and optically coupled to a photodiode 38. Other parts of the circuit correspond with those parts shown in FIG. 3 so that the opto coupler is arranged to feed the triac 5, the other triacs 6, 7 and 8 being similarly connected to opto couplers not shown.

As shown in the drawing, the transducers 1 to 4 may be shunted with capacitors 1*a l to 4a* to compensate for manufacturing tolerances so that each transducer presents the same impedance to its associated triac.

What we claim is:

1. An electronic drive signal distribution arrangement for use in an ultrasonic fuel supply system for an internal combustion engine, said engine adapted to produce control pulses dependent on engine operating conditions, comprising:

a plurality of piezo-electric transducers each adapted to be coupled with a fuel injection nozzle for supplying fuel to the internal combustion engine;

an oscillator for producing an ultrasonic signal for driving the transducers;

a plurality of triacs, each triac associated with a separate transducer;

means for connecting said triacs with said oscillator so that signal bursts from the oscillator are fed to the transducers via the triacs;

opto-coupler means for controlling the conduction of said triacs in dependence upon the control pulses; and a plurality of capacitors, each capacitor being shunted with a particular transducer, said capacitors chosen so that the capacitance presented to each triac is substantially the same.

2. An electronic drive signal distribution arrangement as claimed in claim 1 wherein the opto coupler means comprise a plurality of opto couplers, each opto coupler comprising an input photo diode optically coupled to an output photo transistor, and a plurality of coupling transistors, each coupling transistor interconnecting said output photo transistor to an associated triac.

3. An electronic drive signal distribution arrangement as claimed in claim 2 further comprising power supply means for supplying electrical power to said opto couplers and coupling transistors comprising a winding electrically coupled to said oscillator, a diode full wave bridge rectifier connected to said winding, and means for interconnecting said rectifier to said opto couplers and coupling transistors.

4. An electronic drive signal distribution arrangement as claimed in claim 3 wherein each coupling transistor is connected in a Darlington configuration to the photo transistor.

* * * * *